US007691044B2

(12) United States Patent
Petratto

(10) Patent No.: US 7,691,044 B2
(45) Date of Patent: Apr. 6, 2010

(54) CREASING-FOLDING MACHINE FOR PRODUCING PAPER AND BOOKBINDING ARTICLES

(75) Inventor: Giorgio Petratto, Venaria Reale (IT)

(73) Assignee: Petratto S.R.L., Pianezza (IT)

( * ) Notice: Subject to any disclaimer, the term of this patent is extended or adjusted under 35 U.S.C. 154(b) by 249 days.

(21) Appl. No.: 11/719,889

(22) PCT Filed: Nov. 23, 2005

(86) PCT No.: PCT/EP2005/056179

§ 371 (c)(1),
(2), (4) Date: May 22, 2007

(87) PCT Pub. No.: WO2006/056580

PCT Pub. Date: Jun. 1, 2006

(65) Prior Publication Data

US 2009/0111674 A1 Apr. 30, 2009

(30) Foreign Application Priority Data

Nov. 23, 2004 (IT) ..... TO04A0826

(51) Int. Cl.
*B31B 1/25* (2006.01)

(52) U.S. Cl. ..... 493/397; 493/400

(58) Field of Classification Search ..... 493/352–357, 493/397–400, 424, 434, 435, 442; 83/674
See application file for complete search history.

(56) References Cited

U.S. PATENT DOCUMENTS

| | | | | |
|---|---|---|---|---|
| 2,238,542 A | | 4/1941 | Talbot | |
| 3,683,734 A | * | 8/1972 | Claussen | 83/674 |
| 3,857,314 A | * | 12/1974 | Gregoire | 83/674 |
| 4,548,112 A | | 10/1985 | Thomas | |
| 4,696,212 A | | 9/1987 | Tokuno et al. | |
| 5,063,769 A | * | 11/1991 | Retallick | 72/379.6 |
| 6,086,522 A | * | 7/2000 | Hechler | 493/420 |
| 6,627,026 B2 | * | 9/2003 | Andersson et al. | 156/168 |
| 7,090,631 B2 | * | 8/2006 | Boss | 493/367 |
| 7,097,607 B2 | * | 8/2006 | De Matteis | 493/424 |
| 2003/0092551 A1 | * | 5/2003 | Boss | 493/424 |
| 2003/0191001 A1 | * | 10/2003 | Guiot et al. | 493/82 |
| 2004/0154485 A1 | * | 8/2004 | Boss | 101/226 |
| 2006/0254209 A1 | * | 11/2006 | Hopwood et al. | 53/64 |

FOREIGN PATENT DOCUMENTS

| | | |
|---|---|---|
| DE | 89 00 516 | 3/1989 |
| DE | 101 62 446 | 7/2002 |
| DE | 101 58 522 | 8/2002 |
| DE | 102 52 586 A1 | 5/2003 |
| EP | 0 403 089 | 12/1990 |
| EP | 0 953 372 | 11/1999 |
| EP | 1 167 012 | 1/2002 |

* cited by examiner

*Primary Examiner*—Louis K Huynh
(74) *Attorney, Agent, or Firm*—Berenato & White, LLC

(57) ABSTRACT

A creasing-folding machine, for producing paper and bookbinding articles, has a feed unit, for feeding sheets along a feed path, a creasing unit, and a folding unit in series with one another; the creasing unit has at least one creasing roller positioned with its axis perpendicular to the feed path and having, on its lateral surface, a creasing blade extending crosswise to the feed path, and a pressure roller which cooperates with an opposite face of each sheet to the creasing roller; the creasing unit is interposed between the feed unit and the folding unit to perform transverse creasing operations upstream from the folding unit.

14 Claims, 3 Drawing Sheets

1
2
3
3
4
5
6
7
8
9
10
11
11
14
14
15
15
16
16
18
18
19
19
20
20
20
20
21
21
21
21
22
22
22
22
23
24
A.P
B
C
II
II

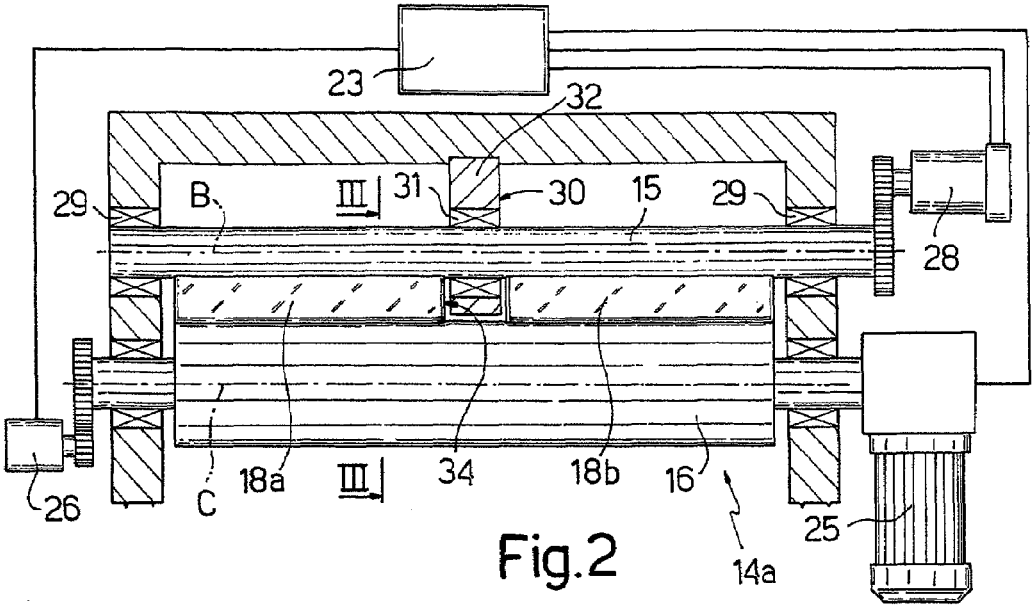
Fig.2
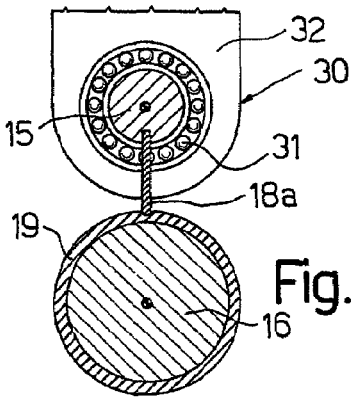
Fig.3
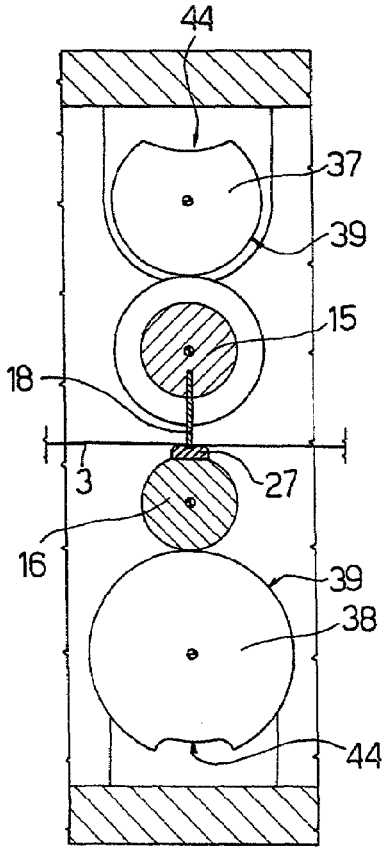
Fig.5
Fig.7
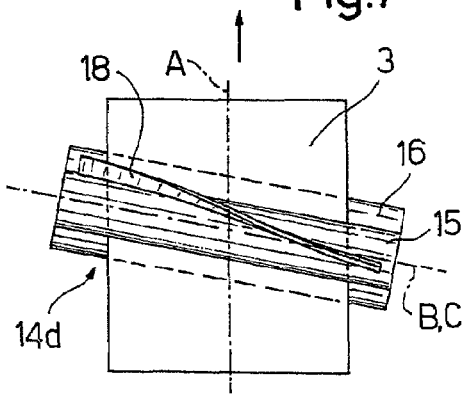

CREASING-FOLDING MACHINE FOR PRODUCING PAPER AND BOOKBINDING ARTICLES

This application is a 371 national stage of PCT/EP2005/056179 filed Nov. 23, 2005, which claims priority from an Italian Patent Application No. T02004A000826 filed Nov. 23, 2004.

TECHNICAL FIELD

The present invention relates to a creasing-folding machine for producing paper and bookbinding articles, such bookcovers, pamphlets, folders, brochures.

BACKGROUND ART

A folding machine is known to be associated with a creasing unit for performing auxiliary creasing operations, i.e. forming crease lines on sheets to assist subsequent folding. Creasing is particularly necessary when working with thick sheets or sheets plastic-coated on one or both sides.

A creasing unit with a rotating circular blade is known to be located in series with a folding unit to form creases lengthwise with respect to the travelling direction of the sheets. This solution permits continuous operation, i.e. without stopping the sheets to form the creases, but is limited in scope, by not allowing for transverse creases for use on a pocket-type folding unit, and by having a tendency to damage the paper.

A creasing unit with a reciprocating blade is also known to be located upstream from the folding unit to form creases crosswise to the travelling direction of the sheets for use at the subsequent folding stage. A reciprocating-blade unit, however, calls for stopping the sheet, and the creasing operation, though excellent from the technical standpoint and variously controllable, is relatively slow and fails to make the best use of the machine's output potential.

DISCLOSURE OF INVENTION

It is an object of the present invention to provide a creasing-folding machine for producing paper and bookbinding articles, designed to eliminate the aforementioned drawbacks typically associated with known machines.

According to the present invention, there is provided a machine as claimed in claim 1.

BRIEF DESCRIPTION OF THE DRAWINGS

A number of preferred, non-limiting embodiments of the present invention will be described by way of example with reference to the accompanying drawings, in which:

FIG. 2 shows a schematic section, along line II-II in FIG. 1, of a first embodiment of a creasing assembly of the FIG. 1 machine;

FIG. 3 shows a section along line III-III in FIG. 2;

FIG. 5 shows a section along line V-V in FIG. 4;

FIG. 7 shows a schematic top plan view of a fourth embodiment of a creasing assembly of the FIG. 1 machine.

BEST MODE FOR CARRYING OUT THE INVENTION

Figure 1:
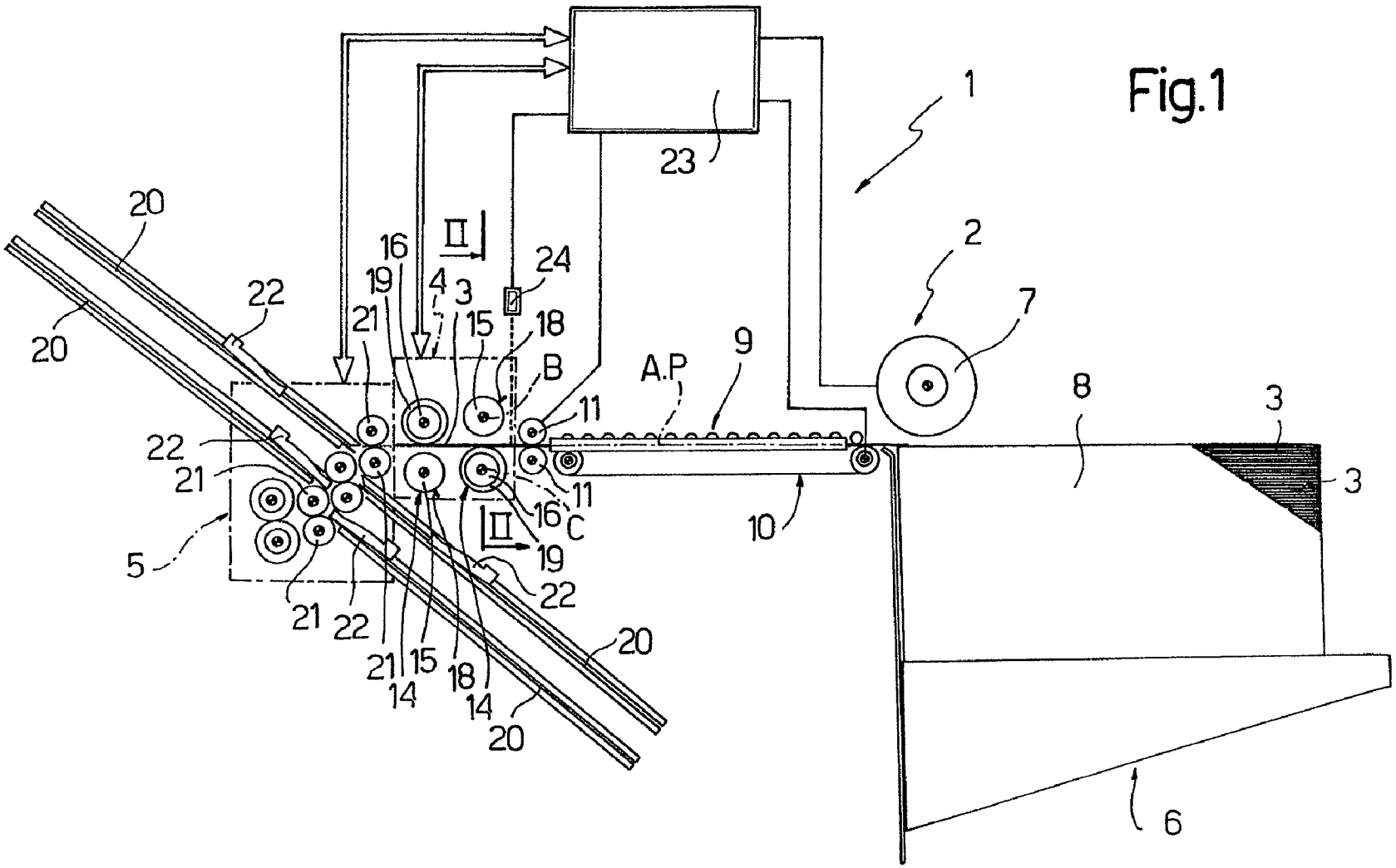
FIG. 1 shows a schematic side view of a creasing-folding machine in accordance with the present invention.

Number 1 in FIG. 1 indicates a creasing-folding machine for producing paper and bookbinding articles.

Machine 1 substantially comprises a feed unit 2 for feeding sheets 3 along a feed path A lying in a plane P; a creasing unit 4 located along path A to receive sheets 3 successively; and a folding unit 5 at the output of creasing unit 4.

Feed unit 2 is known, and therefore not described in detail, and may comprise, purely by way of a non-limiting example, a stack-type sheet loader 6; a suction roller 7 for removing sheets 3 one at a time off the stack 8 of sheet loader 6; and a squaring device 9 for squaring the sheets and employing an oblique belt 10.

At the output, immediately adjacent to creasing unit 4, feed unit 2 also comprises two traction rollers 11—at least one of which is powered—to ensure sheets 3 are fed successively to creasing unit 4 at a known travelling speed.

It should be pointed out that machine 1 may be combined in series with other machines, so that feed unit 2 may be at least partly replaced by the output assembly of an upstream machine, and simply comprise traction rollers 11.

In FIG. 1, creasing unit 4 is only shown schematically as regards the main characteristics common to all the preferred embodiments, which are shown in more detail in FIGS. 2 to 6 and described individually below with reference to FIGS. 2 to 6.

Figure 4:
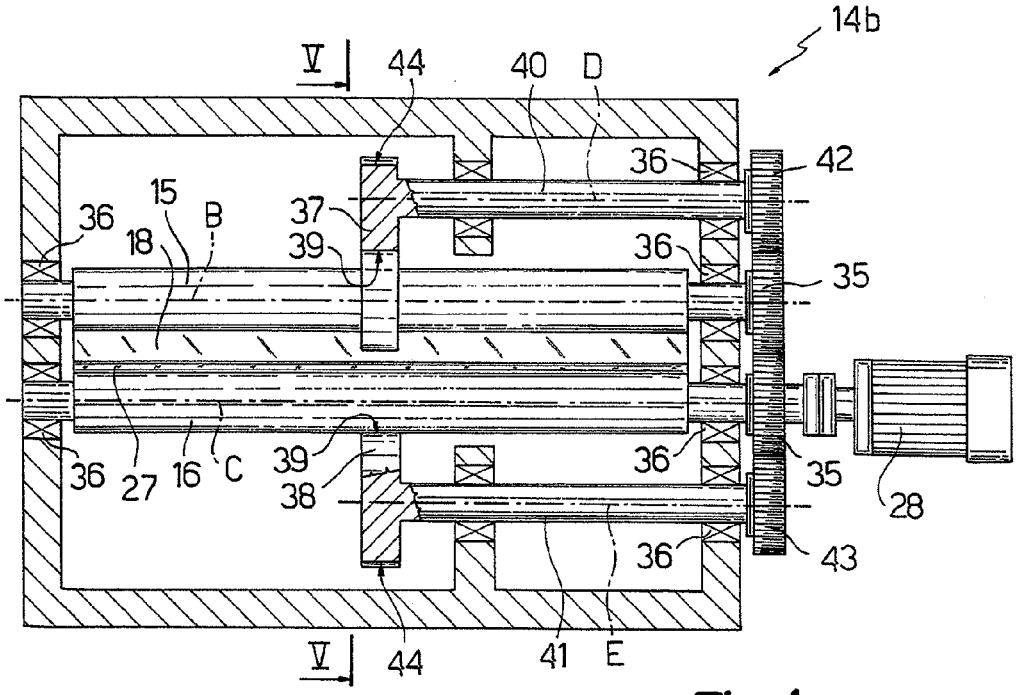
FIG. 4 shows a schematic section, along line II-II in FIG. 1, of a second embodiment of a creasing assembly of the FIG. 1 machine.

The creasing unit 4 conveniently comprises two cascade creasing assemblies 14, each of which comprises a creasing roller 15 and a pressure roller 16 having parallel fixed axes B and C and cooperating with opposite faces of sheets 3, as shown in FIGS. 2 and 4). The term "fixed" as used herein is intended to indicate that the axes B and C are not readily movable, stationary relative to a fixed structure of the creasing-folding machine 1. The two creasing assemblies 14 are inverted with respect to each other, so that creasing roller 15 of one assembly is above, and the other below, plane P, to permit creasing in opposite directions, i.e. raised and recessed, and so permit folding in both directions.

Each creasing roller 15 comprises a creasing blade 18 for locally deforming the fibres of the sheet without cutting it. The creasing blade (18) extends radially from a lateral surface of the creasing roller (15) and is fixed thereto crosswise to the feed path (A). Each of the pressure rollers 16 is conveniently covered with a layer 19 of elastomeric material (FIG. 3) to form a flexible work support for the sheet 3. Alternatively, rollers 16 may be fitted with dies 27 (FIG. 5) cooperating with the respective blades 18.

Folding unit 5 is a conventional pocket type, and therefore not described in detail. Briefly, it comprises a number of, e.g. four, cascade pockets 20 preferably arranged in twos on opposite sides of a group of traction rollers 21 so arranged as to feed sheet 3 from one pocket to the next. Each pocket 20 comprises a diverting member 22 movable between a withdrawn position (shown in the first two pockets) and a forward position (shown in the last two pockets). In the withdrawn position, which is adjustable, diverting member 22 lets sheet 3 into the pocket, acts as a stop for a leading edge of the sheet, and forces the sheet to fold under the traction exerted by the traction rollers. In the forward position, diverting member 22 prevents the sheet from entering pocket 20, and diverts it towards traction rollers 21 of the next pocket 20 without folding it.

Feed unit 2, creasing unit 4, and folding unit 5 are controlled by a programmable control unit 23 governing overall operation of the machine. More specifically, control unit 23 is connected to an optical sensor 24 for detecting the presence of a sheet 3 at the input of creasing unit 4 and controlling creasing assemblies 14 as described in detail below.

With reference to FIGS. 2 and 3, number 14*a* indicates a first embodiment of a creasing assembly 14 of creasing unit 4. Creasing assembly 14*a* comprises a creasing roller 15 defined by a relatively small-diameter, hence low-inertia, shaft; and a solid, larger-diameter pressure roller 16 covered with a layer 19 of elastomeric material.

Pressure roller 16 is substantially rigid and only supported at the ends.

Pressure roller 16 is driven by an electric power motor 25 directly, as shown, or via a synchronous drive, e.g. a timing belt; traction rollers 11 are conveniently driven by the same motor 25 via a synchronous drive (not shown); and motor 25 is controlled by control unit 23 by means of an encoder 26, which determines the speed and angular position of roller 16 (or of another shaft connected angularly to it) and supplies control unit 23 with input signals indicating the speed and position of sheet 3.

Creasing roller 15 is driven by an independent brushless electric motor 28 with an encoder for speed and position control by control unit 23.

To prevent creasing roller 15 from bending under the work load, in addition to the usual end supports 29, an intermediate support 30 is provided, defined by a bearing 31 mounted in a bracket 32 forming part of the fixed structure of the machine. Creasing blade 18 is divided into two parts 18*a*, 18*b* located on axially opposite sides of intermediate support 30 and forming a gap 34 in between to avoid interference with support 30.

Creasing assembly 14*a* operates as follows.

Sheets 3 are fed in known manner along path A at a constant travelling speed defined by traction rollers 11 and pressure roller 16; the distance between sheets 3 is not controlled, and is therefore not constant.

When a sheet 3 is detected by sensor 24, brushless motor 28 is accelerated, according to a predetermined speed curve memorized in control unit 23, so that blades 18*a*, 18*b* are brought to a tip speed equal to the travelling speed of sheet 3, and to an appropriate angular position in which to interact with sheet 3 and form the crease in the predetermined position.

Creasing roller 15 being a shaft with a much lower moment of inertia than a solid roller, rapid speed transients, and therefore extremely high production speeds, can be achieved using a relatively low-power—and therefore small-size, low-inertia—brushless motor 28. Another important point to note is that, during operation, the interaction under pressure between blades 18*a*, 18*b* and pressure roller 16 results in "traction" of creasing roller 15 by pressure roller 16, so that brushless motor 28 substantially only provides, with very little power, for speed and position control. Creasing roller 15 being supported in the middle, there is substantially no bending, so that the above advantages of using a lightweight, low-inertia creasing roller 15 are achieved with no impairment whatsoever in the quality of the work. The small break in the crease produced by gap 34 between blades 18*a*, 18*b* is normally acceptable, and does not impair the quality of the folds made by unit 5.

FIGS. 4 and 5 show a variation, indicated 14*b*, of the creasing assembly.

In assembly 14*b*, which is only described insofar as it differs from assembly 14*a*, pressure roller 16 is also as lightweight as possible, and is in the form of a relatively small-diameter shaft fitted with a creasing die 27 cooperating with creasing blade 18 which, in this case, is in one piece. Because of the presence of creasing die 27, rollers 15 and 16 are timed with respect to each other. More specifically, rollers 15, 16 are connected angularly to each other by two meshing gears 35 integral with the respective rollers.

One brushless motor 28, controlled by control unit 23, drives both rollers 15, 16, so that, in this case, roller 16 is independent of traction rollers 11.

Both creasing roller 15 and pressure roller 16 are supported at both ends by conventional bearings 36, and in the middle by opposed contrast disks 37, 38, which rotate about respective axes D, E parallel to axes B, C of rollers 15, 16, and lying in the plane defined by axes B, C, on opposite sides of rollers 15, 16. Disks 37, 38, which cooperate in contact with respective rollers 15, 16 by means of respective lateral contact surfaces 39, are supported by respective shafts 40, 41 timed with respect to rollers 15, 16 by means of respective gears 42, 43 meshing with respective gears 35. Disks 37, 38 have respective recesses 44, which form breaks on surfaces 39 to prevent interference with creasing blade 18 and die 27 respectively.

This solution has the same advantages as assembly 14*a*. In addition, both rollers 15, 16 are driven by a single brushless motor 28 which, given the minimum inertia of the two rollers, may be low-power; and intermediate support of rollers 15, 16 by disks 37, 38 with recesses 44 allows a one-piece creasing blade 18 and one-piece die 27 to be used.

Figure 6:
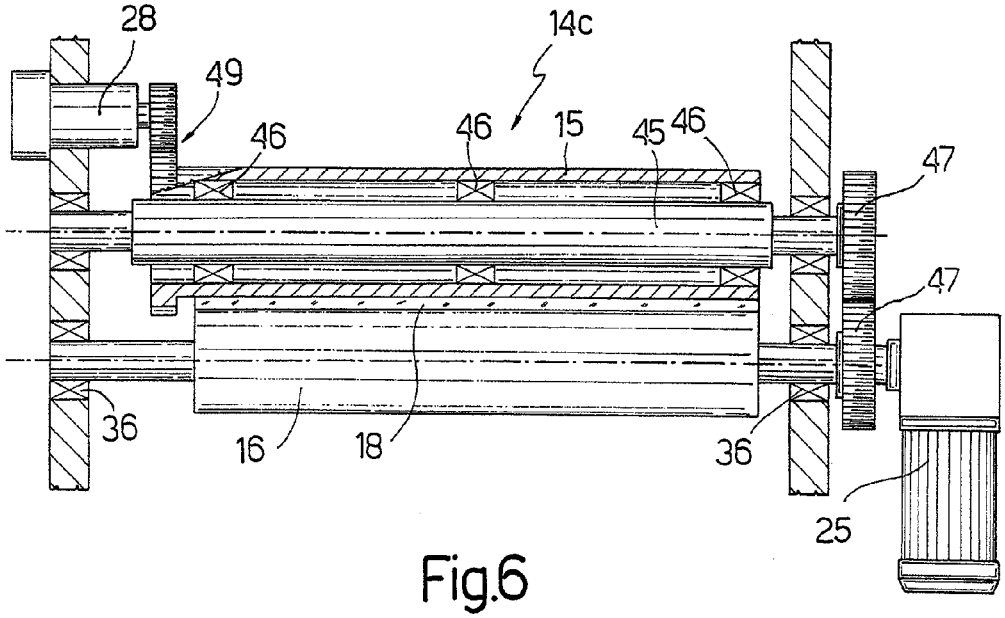
FIG. 6 shows a schematic section, along line II-II in FIG. 1, of a third embodiment of a creasing assembly of the FIG. 1 machine.

FIG. 6 shows a creasing assembly 14*c* in accordance with a further variation of the invention, in which pressure roller 16 is a solid roller covered with elastomeric material, as in assembly 14*a*, can therefore be supported in conventional manner at the ends only by bearings 36, and is powered independently of roller 15.

Creasing roller 15 is in the form of a hollow cylinder, and is mounted idly on a supporting shaft 45 extending through the hollow cylinder by means of bearings 46—preferably three bearings 46, two of which define end supports, and the third an intermediate support, for supporting roller 15 on shaft 45.

Creasing roller 15 is conveniently powered by a brushless electric motor 28 with an encoder, and possibly via a synchronous belt drive 49. Shaft 45 and pressure roller 16 are connected to each other, e.g. by two gears 47, and are driven by an electric motor 25 substantially more powerful than brushless motor 28, and which conveniently also drives traction rollers 11 via a synchronous drive (not shown).

Creasing roller 15 being supported internally, this solution combines the advantages of assembly 14*a* with the possibility of employing a one-piece creasing blade 18.

FIG. 7 shows a creasing assembly 14*d* in accordance with a further variation of the present invention. In assembly 14*d*, rollers 15, 16 have axes B, C parallel to each other and to plane P, but not perpendicular to path A of sheets 3. As opposed to being straight and extending along a generating line of the roller, as in the above embodiments, creasing blade 18 is helical, with the helix so inclined as to compensate for the tilt of the roller axis and so form on sheets 3 straight creases perpendicular to path A.

The advantage of this solution lies in blade 18 contacting sheet 3 gradually, as opposed to simultaneously along the full length of the blade, so that the reaction forces on creasing roller 15 are reduced, thus reducing bending of the roller.

Using a combination of two cascade creasing assemblies 14 of any of the types described, upstream from folding unit 5 and one inverted with respect to the other, creases can be formed in both directions and with any spacing. Given the low inertia of roller 15, and hence the possibility of easily achieving any speed profile by means of brushless motor 28, each assembly 14 can obviously act repeatedly on sheets 3 to form a number of parallel creases spaced programmable distances apart. That is, it is possible to temporarily accelerate or decelerate creasing roller 15 with respect to pressure roller 16 and traction rollers 11 (assemblies 14*a*, 14*c*), or both rollers 15, 16 with respect to traction rollers 11 (assembly 14*b*), according to appropriate speed profiles, to bring creasing blade 18 (and die 27, if any) into contact with the sheet after a programmable time interval. Obviously, before sheet 3 is contacted, the rotation speed of roller 15 (and of roller 16, if timed as in assembly 14*b*) must be brought back to a value corresponding to the travelling speed of sheet 3.

Clearly, changes may be made to machine 1, and in particular to creasing assemblies 14, as described herein without, however, departing from the protective scope as defined in the accompanying Claims.

In particular, creasing blade 18 may move along other than the circular path described, and may be carried, for example, by any mechanism capable of moving it along a non-circular path, but substantially tangent to the plane of sheet 3, in programmable manner coordinated with travel of the sheet. The term "substantially tangent" being intended to mean that the depth of the crease actually determines interference between the blade edge position envelope and the sheet plane in the strictly geometrical sense.

Creasing rollers 15 may comprise a number of blades 18, as opposed to only one; and intermediate support 30 or 46 of creasing roller 15 may even be dispensed with, if roller 15 is rigid enough to ensure acceptable bending under the work load.

The invention claimed is:

1. A creasing-folding machine for producing paper and bookbinding articles, comprising:

feed means (2) for supplying sheets (3) and feeding said sheets (3) in a feed plane (P) along a feed path (A);

a creasing unit (4); and a folding unit (5) in series with said creasing unit (4);

said creasing unit (4) comprising two creasing assemblies (14) cascaded along the feed path (A);

each of said creasing assemblies (14) including a creasing roller (15) and a pressure roller (16) having respective fixed axes (B, C) parallel to each other, crosswise to said feed path (A) of said sheets (3) and disposed on opposite sides of said feed plane (P), and a creasing blade (18) extending radially from a lateral surface of said creasing roller (15) and fixed thereto crosswise to said feed path (A) so as to move along a path substantially tangent to said feed path (A) of said sheets (3) upon rotation of said creasing roller (15), said creasing blade (18) and said pressure roller (16) of each of said creasing assemblies (14) being adapted to contact opposite faces of said sheets, said creasing assemblies (14) being inverted with respect to each other;

said creasing rollers (15) being driven by brushless electric motors;

each of said creasing assemblies (14) further comprising an intermediate support (30) cooperating with the respective creasing roller (15) in an intermediate position along said creasing roller (15) to limit bending under work loads;

said creasing unit (4) being located upstream from said folding unit (5) to perform transverse creasing operations upstream from said folding unit (5).

2. The machine as claimed in claim 1, wherein said intermediate support (30) comprises a bearing (31) outside said creasing roller (15).

3. The machine as claimed in claim 2, wherein said creasing blade (18) is interrupted at said intermediate support (30).

4. The machine as claimed in claim 1, wherein said intermediate support comprises a contrast disk (37), which has an axis (D) parallel to the axis (B) of said creasing roller (15), and is located on the opposite side of said creasing roller to said pressure roller (16), so as to cooperate with said creasing roller (15) along a lateral surface (39) of said contrast disk.

5. The machine as claimed in claim 4, said contrast disk (37) is timed angularly with respect to said creasing roller (15), and has a recess (44) on said lateral surface (39) to avoid interference with said creasing blade (18).

6. The machine as claimed in claim 1, wherein said creasing roller (15) is a hollow cylinder mounted idly on a supporting shaft (45) extending through said hollow cylinder.

7. The machine as claimed in claim 6, wherein said intermediate support comprises a bearing (46) inside said creasing roller (15).

8. The machine as claimed in claim 6, wherein said pressure roller (16) and said supporting shaft (45) of each of said creasing assemblies (14) are connected angularly to each other.

9. The machine as claimed in claim 1, further comprising a sensor (24) for detecting the presence of said sheets (3) entering said creasing unit (4); and a control unit (23) for controlling said feed means (2) and said creasing roller (15) supporting said creasing blade (18) so as to coordinate the movement of said creasing blade (18) with supply of said sheets (3) by said feed means (2).

10. The machine as claimed in claim 1, wherein said pressure roller (16) of each of said creasing assemblies (14) has a covering (19) of flexible material.

11. The machine as claimed in claim 1, wherein said pressure roller (16) of each of said creasing assemblies (14) is powered.

12. The machine as claimed in claim 1, wherein said pressure roller (16) comprises a creasing die (27) cooperating with said creasing blade (18).

13. The machine as claimed in claim 12, wherein said creasing roller (15) and said pressure roller (16) are connected angularly to each other.

14. The machine as claimed in claim 1, wherein said folding unit (5) includes a number of pockets.

* * * * *